United States Patent [19]

Webster et al.

[11] 3,954,514

[45] May 4, 1976

[54] TEXTURELESS FORGING OF BERYLLIUM

[75] Inventors: Donald Webster, Saratoga; Donald D. Crooks, San Jose, both of Calif.

[73] Assignee: Lockheed Missiles & Space Company, Inc., Sunnyvale, Calif.

[22] Filed: Apr. 2, 1975

[21] Appl. No.: 564,427

[52] U.S. Cl. ..... 148/11.5 F

[51] Int. Cl.[2] ..... C22D 1/18

[58] Field of Search ..... 148/11.5 R, 11.5 F

[56] References Cited

UNITED STATES PATENTS

| | | | |
|---|---|---|---|
| 3,483,047 | 12/1969 | Buchanan et al. | 148/11.5 F |
| 3,699,798 | 10/1972 | Anderson, Jr. et al. | 148/11.5 F |

*Primary Examiner*—W. Stallard

*Attorney, Agent, or Firm*—Richard H. Bryer; B. G. Corber

[57] ABSTRACT

A method for enhancing the mechanical properties of beryllium and beryllium alloy bodies by deforming and recrystalizing cast and hot pressed beryllium bodies to a finer grain microstructure than initially present in the bodies without introducing a pronounced crystallographic texture into the bodies. More particularly, the beryllium body undergoes a textureless forging process by which the body is plastically deformed at elevated temperatures with the resulting metal flow being restricted to only one axis of the body. The deformed body is then restored to essentially its original shape and annealed at its recrystalization temperature with a resulting refinement in grain size to a size smaller than that present in the initial body.

4 Claims, No Drawings

TEXTURELESS FORGING OF BERYLLIUM

BACKGROUND OF THE INVENTION

Many engineering alloys are fabricated by casting and hot pressing techniques followed by various types of hot mechanical working to refine the course grain structure and break up impurity agglomerates in the form of inclusions in the structure; however, such a procedure is generally not used with beryllium bodies since the mechanical properties of beryllium, particularly ambient temperature ductility, become anisotropic when beryllium is mechanically worked by conventional techniques such as rolling, extrusion, forging and swwaging. This is caused by non-uniform slip on an atomic scale which causes certain planes (basal) in the crystal lattice to become aligned parallel to the surface of the worked surface. Such alignment of crystal planes called texture causes the metal to have very low ductility perpendicular to the direction in which the predominant metal flow has occurred. In rolled sheet, for example, this means that the ductility through the thinnest section of the sheet is extremely low and the sheet can tolerate very little bending before fracturing in a brittle matter.

Since deformation and subsequent recrystalization to a refined microstructure are traditional ways of improving the properties of many engineering alloys it would be desirable to be able to deform beryllium without producing texture.

SUMMARY OF THE INVENTION

Briefly, in accordance with the invention, there is described a process for improving the ductility of beryllium and beryllium alloy bodies which permits plastic deformation of such bodies without introducing a pronounced texture into the processed body. The plastic deformation is sufficient to permit recrystalization of the bodies to a grain structure finer than that initially present in such bodies. The finer grain structure enhances the mechanical properties of both cast and hot pressed beryllium bodies.

More particularly, the process involves a forging operation in which the cast or hot pressed body is subjected to a number of forging blows at an elevated temperature, preferably between 800°F and about 2,000°F. The metal flow resulting from each blow is restricted to only one axis of the body. Each odd-numbered blow deforms the body along an axis of metal flow which is aproximately 90° to the axis of the blow. The resulting deformation caused by the odd-numbered blow results in a reduction in the height of the original body of approximately 5% to about 60%. Each even-numbered blow is along the axis of metal flow of the preceding odd-numbered blow. That is, the even-numbered blows are at 90° to the odd-numbered blows and are of sufficient magnitude to essentially restore the deformed body to its original shape. Preferably the body is rotated 90° for each odd-numbered blow to assure uniformity in processing and hence uniform mechanical properties. While there is no theoretical limit to the defree of working of the body, since unlike other working operations there is no change of shape in the final product, it has been determined that typically the number of blows required to form a fine grain microstructure is 10 or less. Subsequent to the desired number of forging blows, the body is annealed at its recrystalization temperature, typically in the range of 1,400°F to 2,250°F, which results in grain refinement of the body to a grain size smaller than that initially present in the body.

DESCRIPTION OF THE PREFERRED EMBODIMENTS

In accordance with the invention, it has been determined that the development of crystallograhic texture can be substantially retarded or prevented by a working operation that is reversible followed by an annealing operation. In one embodiment an initial forging cube is deformed by a forging blow to 50% of its original height in a die which restricts metal flow along only one axis of the body 90° to the blow. This first forging blow results in a pronounced texture in the beryllium body, but this texture is eliminated when the second forging blow is at right angles to the first blow, such that the metal flow is reversed and the original cube is reformed. After the second blow the texture is eliminated and the internal microstructure is rendered unstable. The microstructure is then recrystalized to a new and finer grain structure during a subsequent anneal. The degree of reduction and reformation of the body resulting from each forging blow is preferably in the range of about 5% to 50%. Typically, up to ten forging blows are sufficient to achieve the desired microstructure fineness, but the body may be worked further since there is no theoretical limit to the amount of work the body may undergo.

To illustrate the difference in texture resulting from the process of the invention and conventional processes, it is convenient to consider basal plane pole figures. These are figures that are devised by an x-ray technique to show the degree of texture in a sample. A figure of (1) denotes a completely random material with no texture. A figure of (3) is slightly textured and a figure of (10) or higher is strongly textured.

In the initial unworked condition, an illustrative hot pressed beryllium alloy BSP9 has a pole figure no higher than 1.5 times random. When the material is worked by a conventional extrusion technique, the pole figure rises to about (12) with most of the basal planes of the beryllium lying parallel to the surface of the extruded sheet. In this condition the alloy has very little ductility in the short transverse direction. In constrast, th same alloy which has been textureless forged 50% in accordance with the invention has a pole figure no greater than 1.5 times random along all axis of the body.

The advantages of the invention are further illustrated by a comparison of stress-strain curves for hot pressed beryllium after textureless forging and annealing and hot pressed beryllium after only annealing. The textureless forging operation was conducted at 1,400°F and involved six blows; the odd-numbered blows reducing the height of the body 25% and the even-numbered blows restoring the body to its original shape. An identical beryllium alloy having the composition 0.48BeO, 0.023C, 0.0146Fe, 0.0025Al, 0.0030Mg, 0.0185Ni, 0.0092Si was utilized in both cases and each body underwent an identical annealing of 1,800°F for 1 hour. At fracture, the textureless forging alloy exhibited a 13.5% strain and a tensile stress of 550 $MN/m^2$(76.5ksi). In contrast, the hot pressed alloy which underwent only the annealing step exhibited at fracture only 7% strain and a tensile strength of 433 $MN/m^2$(61.3ksi). The textureless forging process of the invention improved the tensile elongation of the alloy by almost 100%.

Stress-strain curves of cast beryllium alloys having the composition BeO<<0.02, Fe0.005, CO.01 , AlO.003, SiO.005, MgO.007 were also compared. One alloy underwent textureless forging operation at 1,400°F involving six blows followed by a 1 hour anneal at 1,600°F. The second cast alloy underwent no further process. At fracture, the textureless forging alloy of the invention exhibited 1.5% strain while the other alloy exhibited essentially 0% strain. Again, the textureless forging process of the invention improved tensile elongation by over 100%.

As previously discussed, typically annealing temperatures in the range of 1,400°F to 2,250°F are utilized to recrystalize the microstructure of the beryllium body. The particular recrystalization temperature of any given beryllium or beryllium alloy body is readily ascertainable. Temperatures which greatly exceed the recrystalizationn temperature are not preferred since they promote grain growth in the microstructure to the detriment of mechanical properties. The textureless process is conducted at elevated temperatures preferably between about 800°F and 2,000°F to promote plastic deformation. Lower temperatures can be utilized but are not preferred since plastic deformation is more difficult to achieve. Higher temperatures can also be used but again may result in grain growth to the detriment of mechanical properties.

What is claimed is:

1. A method of enhancing the mechanical properties of beryllium containing bodies comprising the steps of subjecting cast and hot pressed beryllium bodies to a number of forging blows, restricting the metal flow resulting from such blows along only one axis of said body 90° to the blow, each odd-numbered blow deforming said body to a reduction in height from about 5% to 60% and each even-numbered blow being along the axis of metal flow of the preceding odd-numbered blow and essentially restoring the deformed body to its original shape, and annealing said body at a temperature sufficient to recrystalize the microstructure of said body.

2. A method in accordance with claim 1, wherein said forging blows are conducted at temperatures in the order of from about 800°F to about 2,000°F.

3. A method in accordance with claim 1, wherein the annealing of said body is conducted at temperatures in the order of from about 1,400°F to about 2,250°F.

4. A method in accordance with claim 1, wherein said body is rotated approximately 90° for each odd-numbered blow.

* * * * *